US006846157B1

(12) United States Patent
Park

(10) Patent No.: US 6,846,157 B1
(45) Date of Patent: Jan. 25, 2005

(54) COOLING FANS

(75) Inventor: Hee-Keun Park, Taipei (TW)

(73) Assignees: Averatec Inc., Foothill Ranch, CA (US); Averatec Europe GmbH, Hallbergmoos (DE); Averatec Asia Incorporation, Taipei (TW)

( * ) Notice: Subject to any disclaimer, the term of this patent is extended or adjusted under 35 U.S.C. 154(b) by 0 days.

(21) Appl. No.: 10/671,911

(22) Filed: Sep. 24, 2003

(51) Int. Cl.[7] ..... F04D 29/28
(52) U.S. Cl. ..... 415/206; 416/183; 416/185
(58) Field of Search ..... 415/175–178, 415/204, 206; 416/182, 183, 185, 188, 223 B; 361/695–697

(56) References Cited

U.S. PATENT DOCUMENTS 5,044,887 A * 9/1991 Duthie et al. ..... 416/223 B
5,954,124 A * 9/1999 Moribe et al. ..... 361/695
6,132,170 A * 10/2000 Horng ..... 415/178
6,206,641 B1 * 3/2001 Park et al. ..... 416/182
6,511,289 B2 * 1/2003 Yu ..... 415/206
6,540,476 B2 * 4/2003 Huang et al. ..... 416/185
6,568,905 B2 * 5/2003 Horng et al. ..... 415/206
6,568,907 B2 * 5/2003 Horng et al. ..... 416/185
6,637,501 B2 * 10/2003 Lin et al. ..... 361/697
6,643,129 B2 * 11/2003 Fujiwara ..... 361/687
6,688,379 B2 * 2/2004 Huang et al. ..... 361/697
2002/0146318 A1 * 10/2002 Horng ..... 415/204

FOREIGN PATENT DOCUMENTS

JP 6-104584 A * 4/1994 ..... 361/695

* cited by examiner

*Primary Examiner*—Christopher Verdier

(57) ABSTRACT

A cooling fan is characterized in jointing the bottom edges of all the fan leaves of a fan body to a common baseplate closely without any clearance. Therefore, turbulence could be thoroughly eliminated for promoting cooling efficiency when the fan body is driven to rotate.

3 Claims, 6 Drawing Sheets

COOLING FANS

FIELD OF THE INVENTION

This invention relates to cooling fans, and more specifically, it relates to a cooling fan provided with a baseplate beneath the fan leaves, which is capable of eliminating a turbulence, and accordingly a wind resistance generated in the base portion of the cooling fan for promoting the cooling efficiency of the inside electronic components.

BACKGROUND OF THE INVENTION

As the operation speed and power of a generic desktop computer, notebook computer, or MPU device, etc., is stepwise raised, cooling efficiency becomes an issue of extreme importance.

Referring to FIG. 1, an existing cooling fan is usually composed of a shaft assembly (B) pivotally mounted on a frame (A), in which a depression (A1) having an upward and a sideward opening (B1) is centrally formed for receiving the shaft assembly (B) which is radially and outwardly extended to form a plurality of fan leaves (A2) and driven to rotate by an electrical device arranged in the frame (A).

Because the mentioned cooling fan is usually a micro-fan with a small momentum applied for electronic devices, its mechanical efficiency could deteriorate significantly by an incurred turbulence. As indicated by arrowheads in FIG. 2, a clearance could be found between the frame (A) and the shaft assembly (B) to allow the generation of turbulence that would impose an extra resistance on the shaft assembly (B), and also reduce the negative-pressure effect and accordingly the intake quantity of air to consequently result in a degraded cooling effect.

SUMMARY OF THE INVENTION

The primary objective of this invention is to provide an improved cooling fan for solving the problems described above.

In order to realize the foregoing objective, this invention is to provide a cooling fan having a plurality of fan leaves with their bottom edges closely jointed with a common baseplate without any clearance to thereby prevent generation of turbulence.

The merits of this invention could be summarized as the following:

1. No turbulence will be created by closely jointing the fan leaves to the common baseplate;
2. To induce stronger negative-pressure effect is possible by using the common baseplate, and therefore air intake is enhanced to thus promote the cooling efficiency; and
3. Wind resistance is also reduced by using the common baseplate, and therefore, a relatively low-power cooling fan could be sufficient for cooling purposes instead of a high-power one.

For more detailed information regarding advantages or features of this invention, at least an example of preferred embodiment will be fully described below with reference to the annexed drawings.

BRIEF DESCRIPTION OF THE DRAWINGS

The related drawings in connection with the detailed description of this invention to be made later are described briefly as follows, in which.

DETAILED DESCRIPTION OF THE INVENTION

Figure 1:
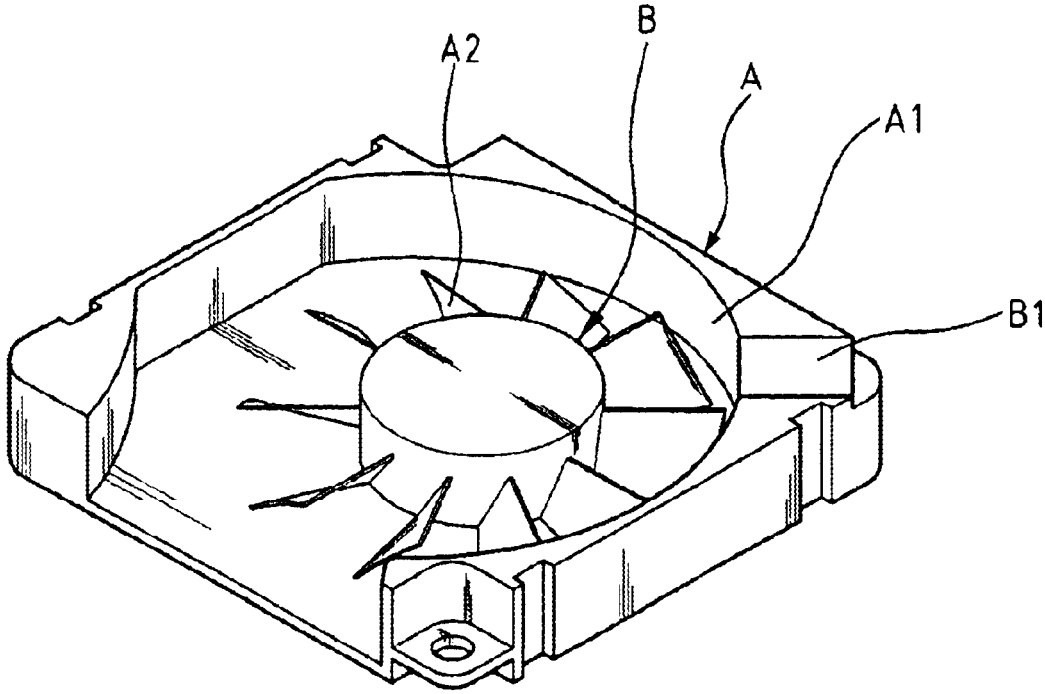
FIG. 1 (PRIOR ART)
FIG. 1 is a three-dimensional view of the structure of a conventional cooling fan.
Figure 2:
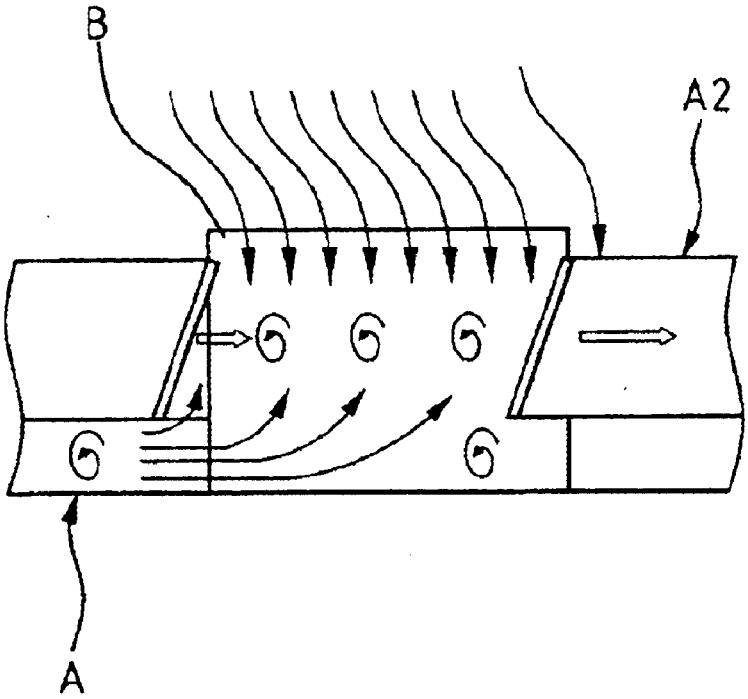
FIG. 2 (PRIOR ART)
FIG. 2 is a side view showing a lateral section and an airflow-guiding path of the conventional cooling fan.
Figure 3:
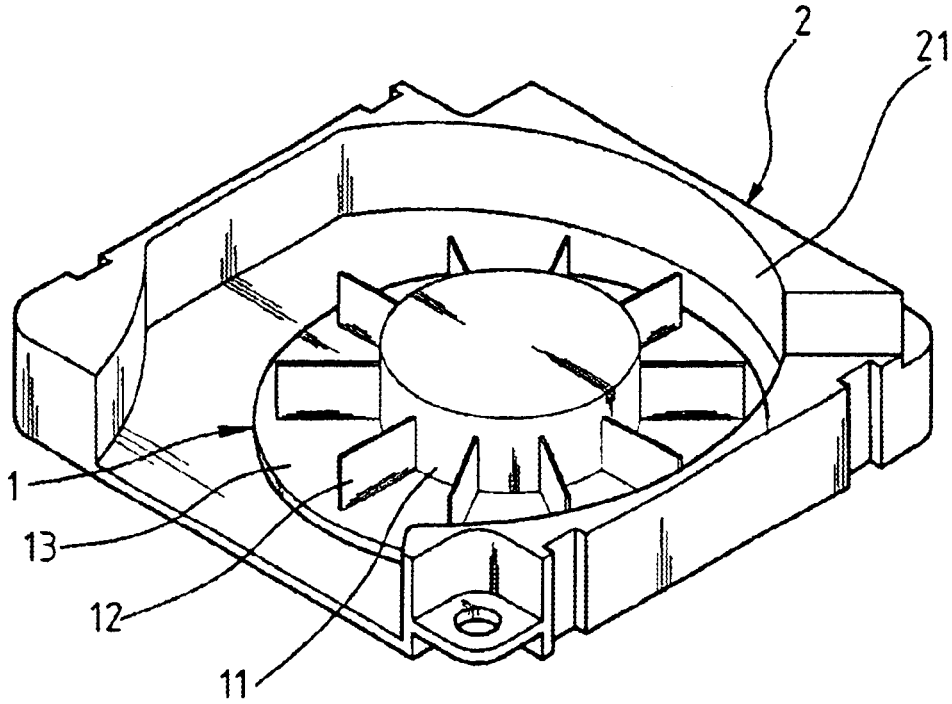
FIG. 3 is a three-dimensional view of the structure of a cooling fan of this invention.

As shown in FIG. 3, an embodiment of the cooling fan of this invention is constructed by mounting a fan body (1) on a base (2), in which a depression (21) having at least an upward and a sideward opening is formed centrally in the primary portion of the base (2), and an electrical device for driving the fan body (1) is available.

The fan body (1) is pivotally jointed to the base (2) through a shaft assembly (11), which is extended outwardly from its circumferential surface to form a plurality of fan leaves (12), in which the bottom edge of each fan leaf (12) is fixedly jointed with a common baseplate (13) formed by extending the circumferential surface of the shaft assembly (11) outwardly, and there is no clearance reserved between every fan leaf (12) and the baseplate (13). As shown in FIG. 3, the baseplate (13) extends outwardly more than the fan leaves (12) which are completed isolated from the space below the baseplate (13) to reduce the wind resistance and induce stronger negative pressure effect. In other words, the outermost edges of the fan leaves are positioned a distance from the edge of the baseplate.

Moreover, in order to mate with the fan body (1), the depression (21) of the base (2) is configured in such a way that the shaft assembly (11) can be driven to rotate the fan leaves (12) synchronously to generate airflow by an electrical device arranged in the base (2).

Figure 4A:
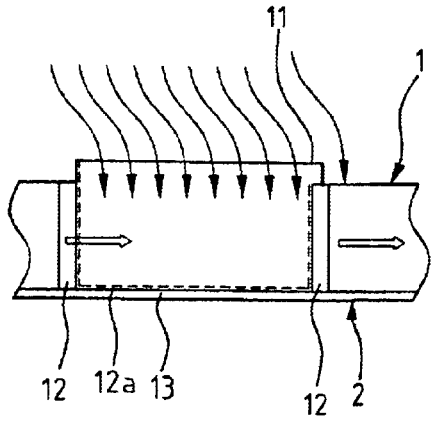
FIG. 4A is a side view showing a lateral section and an airflow-guiding path of the cooling fan of this invention.
Figure 4B:
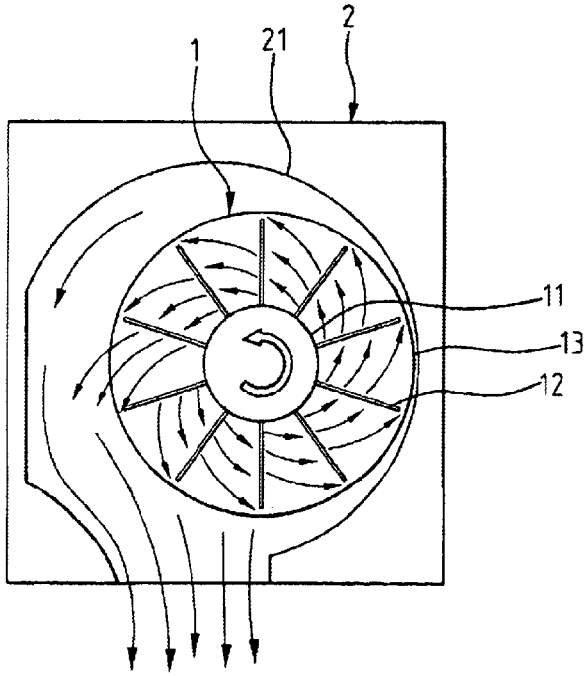
FIG. 4B is a top view showing the airflow-guiding path of the cooling fan of this invention.

When the shaft assembly (11) is driven to rotate by an electrical device of the base (2) as shown in FIGS. 4A and 4B, a negative pressure is created in a space (12*a*) enclosed by every two neighbor leaves and the shaft assembly (11) by the driven fan leaves (12) so that the air above the fan body (1) would flow downwardly to enter the spaces (12*a*) to be guided by the depression (21) of the base (2) to finally flow out of the base (2) through the sideward opening. In this case, no airflow is permitted to enter the bottom portion of every fan leaf (12) for generating any turbulence that could curb the descent of the airflow because there is no clearance between every fan leaf (12) and the baseplate (13).

Figure 5:
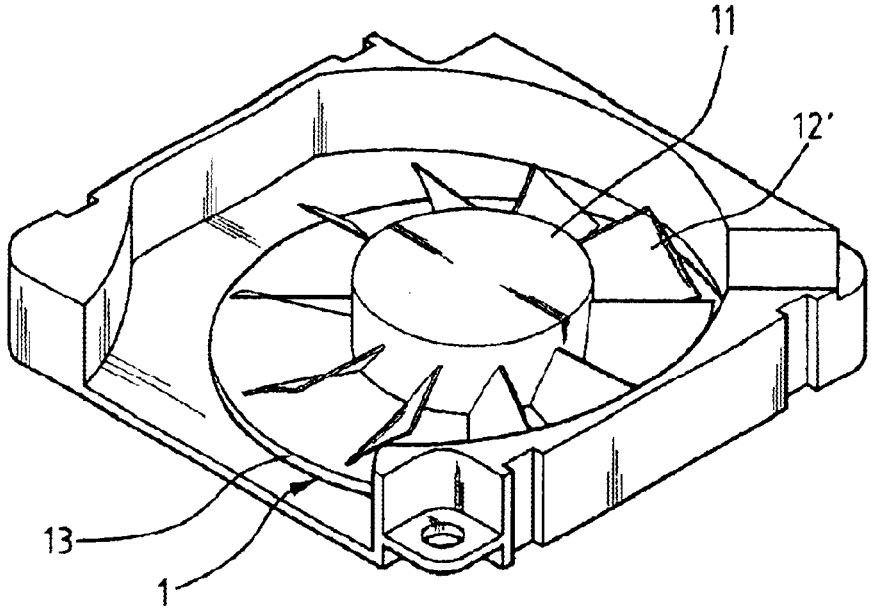
FIG. 5 is a three-dimensional view showing another embodiment of the cooling fan of this invention.
Figure 6:
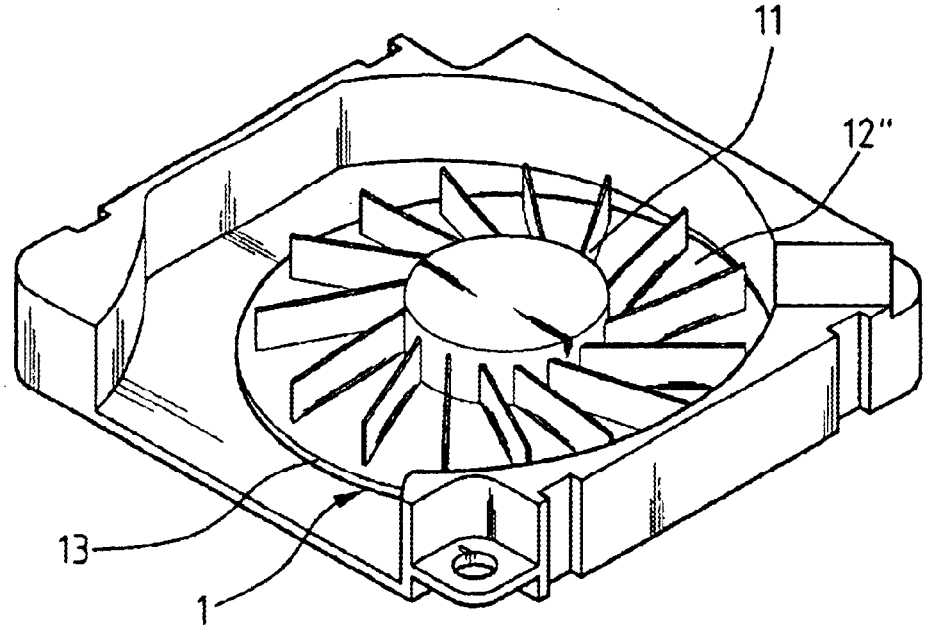
FIG. 6 is a three-dimensional view showing yet another embodiment of the cooling fan of this invention.

FIGS. 5 and 6 show more respective embodiments of this invention. In FIG. 5, each fan leaf (12') of the fan body (1) is twisted by a specific angle to form a curved face, while in FIG. 6, each fan leaf (12") of the fan body (1) forms a plane having a specific deflection angle, in order to enhance the airflow and the output wind pressure by and from the fan body (1) and hence improve the mechanical efficiency thereof. In addition to the efficacies mentioned, to lower the power usually required by the electrical device in the base (2) for driving the fan body (1) and heat generated is also possible.

In the above described, at least one preferred embodiment has been described in detail with reference to the drawings annexed, and it is apparent that numerous changes or modifications may be made without departing from the true spirit and scope thereof, as set forth in the claims below.

What is claimed is:

1. A cooling fan comprising:

a base having a depression formed centrally in said base, said depression having at least an upward opening and a sideward opening;

a fan body pivotally mounted on said base in said depression through a shaft assembly;

a plurality of fan leaves extended outwardly from a circumferential surface of said shaft assembly; and a baseplate extended from said shaft assembly below said plurality of fan leaves and jointed with bottom edges of said plurality of fan leaves;

wherein said baseplate has a circumferential edge extended from said shaft assembly more outwardly than outermost edges of said plurality of fan leaves.

2. The cooling fan according to claim 1, in which each fan leaf is twisted by a specific angle to form a curved face.

3. The cooling fan according to claim 1, in which each fan leaf forms a plane having a specific deflection angle.

* * * * *